US005555812A

United States Patent [19]

Ruckmann et al.

[11] Patent Number: 5,555,812

[45] Date of Patent: Sep. 17, 1996

[54] ARRANGEMENT FOR THE SUPPLY AND REMOVAL OF PRINTING PLATES

[75] Inventors: Wolfgang G. Ruckmann; Erich G. Wieland, both of Würzburg, Germany

[73] Assignee: Koenig & Bauer Aktiengesellschaft, Wurzburg, Germany

[21] Appl. No.: 397,239

[22] Filed: Mar. 17, 1995

[30] Foreign Application Priority Data

Sep. 18, 1992 [DE] Germany ..... 42 31 900.5
Sep. 16, 1993 [DE] Germany ..... 43 31 430.9

[51] Int. Cl.[6] ..... B41F 21/00

[52] U.S. Cl. ..... 101/477; 101/415.1

[58] Field of Search ..... 101/415.1, 477, 101/383, DIG. 36, 216

[56] References Cited

U.S. PATENT DOCUMENTS 5,111,744 5/1992 Wieland ..... 101/216
5,127,328 7/1992 Wieland ..... 101/415.1
5,218,907 6/1993 Komori et al. ..... 101/415.1

FOREIGN PATENT DOCUMENTS 0214549 3/1987 European Pat. Off. .
0432660 6/1991 European Pat. Off. .

*Primary Examiner*—Christopher A. Bennett
*Attorney, Agent, or Firm*—Jones, Tullar & Cooper, P.C.

[57] ABSTRACT

A supply and removal device for supplying printing plates to a plate cylinder utilizes a storage container which has adjacent compartments, one for the removal of printing plates and the other for the supply of printing plates. Each compartment has a mouth opening with the two such openings being located adjacent the surface of the plate cylinder in two adjacent quadrants.

5 Claims, 9 Drawing Sheets

1
12
26
33
62
14
29
28
17
23
34
56
61
60
31
9
58
16
32
7
6
41
8
18
13
73
31
39
87
69
24,A
37
38
64
II
I
44
34
67
43
M
49
57
27
36
48
82
46
42
51
63
59
55
47
68
51
21
50
86
66
III
IV
72
53
52
22
2
3
11
19

ARRANGEMENT FOR THE SUPPLY AND REMOVAL OF PRINTING PLATES

FIELD OF THE INVENTION

The invention relates to a device for supplying and removing printing plates to a plate cylinder of a rotary printing press.

DESCRIPTION OF THE PRIOR ART

A feed and removal device for a printing press is known from EP 02 14 549 B1, wherein, during the removal of the printing plates from the plate cylinder, the printing plates are held by means of guide rollers, which can be placed against the circumference of the plate cylinder, and by associated actuation devices. This is disadvantageous in that these adjustable plate pressure rollers and their actuating devices not only make access to the plate cylinder more difficult, but also require an additional outlay in technical devices. Further than that, a large portion of the circumference of the plate cylinder is occupied by the above mentioned devices, so that only a limited number of cylinders, for example ink application rollers, can be present at the plate cylinder, otherwise the plate cylinder must have larger dimensions. In connection with above mentioned EP 02 14 549 B1 it is furthermore disadvantageous that a driven guide roller is employed during the plate feeding process and is in contact with the sensitive side of the printing plate. This can lead to damage of this sensitive side, particularly if the feed speed of the printing plate is adjustable in the way this is handled in accordance with EP 02 14 549 B1 by accelerating and subsequent slowing down of the plate feed, so that a gentle supply or removal can take place.

During the plate retraction or plate removal process it is furthermore disadvantageous that here too, a driving guide roller is employed which is in contact with the sensitive side of the printing plate, so that damage to it cannot be counted out, which is an obstacle to the reuse of the printing plate.

EP 04 32 660 A2 shows a supply and removal device for printing plates to or from a plate cylinder of a rotary printing press. The supply or removal of the printing plates takes place via a compartment. In this case, the ends of the compartments are aligned tangentially with an arbitrary circle, whose radius maximally takes up the radius of the plate cylinder and minimally the radius of a circle extending barely above a gripper support surface. Such a device for holding the printing plate is provided for a printing plate front edge as well as a printing plate end. The fronts and end of the printing plate supply compartment and the printing plate removal compartment have a common wall.

SUMMARY OF THE INVENTION

It is the object of the invention to produce a device on a printing plate supply and removal device of printing plates to or from a plate cylinder of a rotary printing press by means of which it is made possible to supply the printing plate to or remove it from the plate cylinder, wherein the plate cylinder can turn in the same direction of rotation, for example the production direction, in both cases.

The following advantages in particular are achieved by means of the invention.

Driven conveying members for the printing plates, such as drive rollers, do not come into contact with the ink-carrying sensitive side of the printing plate, so that the printing plate is not damaged during changing and therefore nothing stands in the way of reusing it. Because of the simultaneous use of the ink application rollers as an auxiliary drive or conveyance for the printing plates to be removed, the ink application rollers have a multiple function. Further than that it is possible to place a plurality of ink application rollers against the plate cylinder. Because of the arrangement of air conduits and by blowing on the sensitive side of the printing plate in the storage compartment it is assured that this side does not come into contact with the storage compartment and thus a gentle removal of the printing plates takes place.

DESCRIPTION OF THE PREFERRED EMBODIMENT

Figure 1:
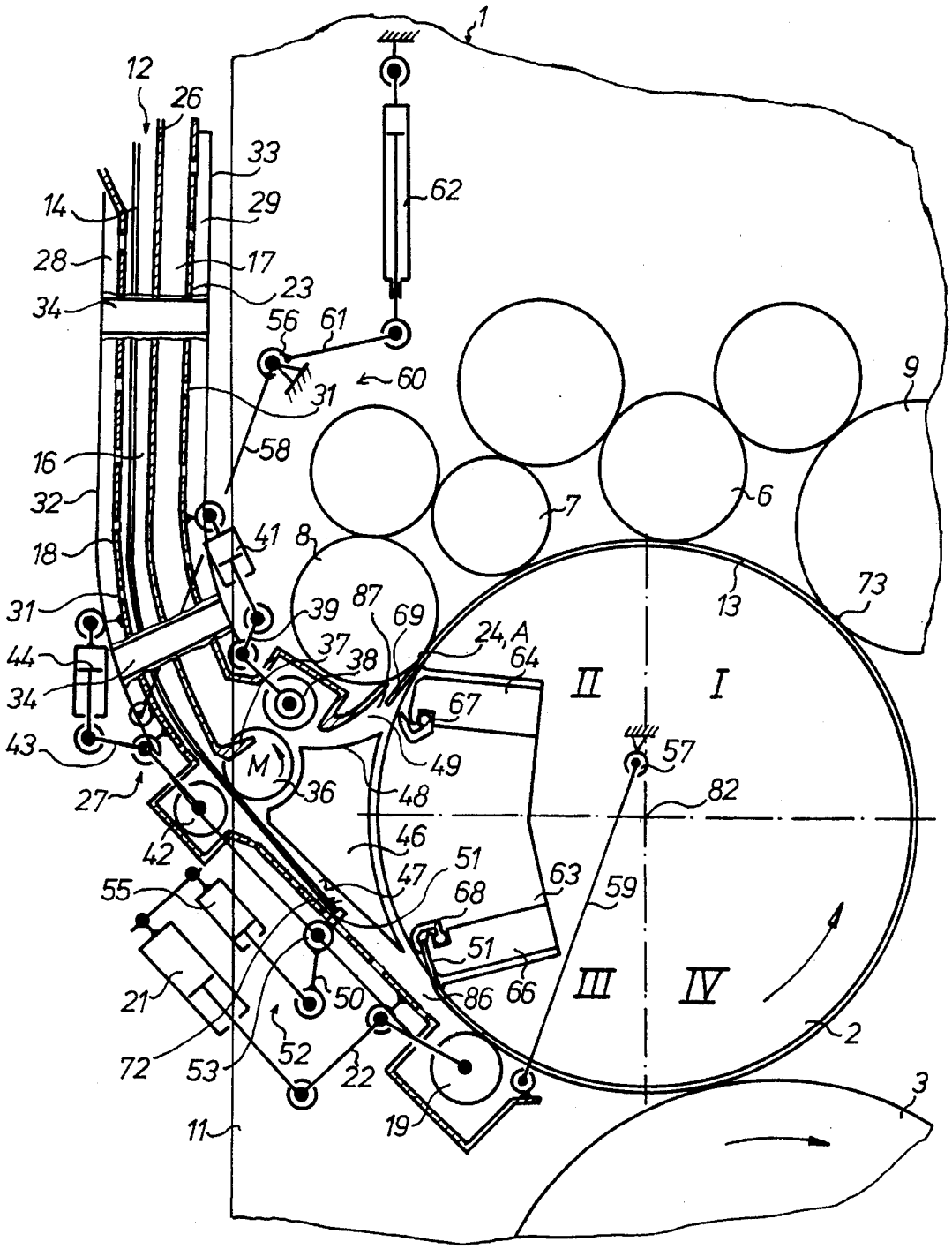
FIGS. 1 to 4, respectively schematic side views of a feed and removal device for printing plates in various positions of the plate cylinder.

The structure of a device in accordance with the invention in the different plate cylinder positions is shown in schematic representations in FIGS. 1 to 4. A rotary printing press has several printing units 1, for example four printing units, each of which contains, among other things, a plate cylinder 2, a rubber blanket 3 and a counterpressure cylinder 4. Furthermore, a number of ink application rollers 6, 7, 8 as well as a moisture and ink application roller 9 are arranged at the circumference of the plate cylinder 2 and can be placed against the plate cylinder 2 by known means, not shown. Distributing rollers, not further identified, are furthermore connected with the rollers 6 to 9. The cylinders 2 to 4 and the rollers 6 to 9 are directly or indirectly seated in side frames. A removal and feed device 12 for printing plates 13, 14 is provided at an access side 11 to the cylinders 2, 3, 4 of the printing unit 1. This device 12 consists of a housing which is approximately as wide as a printing plate and has two storage compartments 16, 17. Viewed in section, the housing has a slight curvature so that an upper portion of the housing initially is oriented almost vertically and the cross section of a lower portion is widened approximately trapezoidally and extends in the direction toward the plate cylinder 2. In this case a front wall 18 of the housing extends past a pressure roller 19.

The pressure roller 19 is disposed slightly below the plate cylinder 2 and can be placed against the plate cylinder 2 by means of a work cylinder 21 fixed on the front wall and of an angle lever 22, also seated on the front wall. In comparison with a printing plate 13, 14, the pressure roller 19 has a soft surface, for example made of rubber or plastic. A rear wall 23 of the housing extends as far as shortly in front of the last ink application roller 8 above a contact line 24 at which the ink application roller 8 touches the plate cylinder 2 or the printing plate 13 on the plate cylinder 2, so that the rear wall 23 has a larger radius of curvature than the front wall 18. An intermediate wall 26 is disposed between the front wall 18 and the rear wall 23 and separates the two storage compartments 16, 17 from each other. However, the intermediate wall 26 is shorter than the walls 18, 23 and terminates in front of a conveying device, identified by 27 as a whole, for printing plates 13, 14. Respectively one air conduit 28, 29 extends parallel with the respective wall 18, 23 and outside of the compartments 16, 17 and is connected via a number of openings 31 with the respective storage compartment 16, 17. The air conduits 28, 29 are bounded by air conduit walls 32, 33 which are placed at a distance from the front wall 18 or the back wall 23. The air conduits 28, 29 are fed by a compressed air supply installation, not shown. The air conduit wall 32, 33, the front and rear walls 18, 23 and the intermediate wall 26 are respectively connected by front walls 34 which are symbolically indicated by two brackets, partially shown in FIG. 1. These front walls 34 extend from the upper part, which runs in the vertical direction, to the end of the trapezoidally widened part of the removal and feed device 12 on the periphery of the plate cylinder 2.

Figure 5:
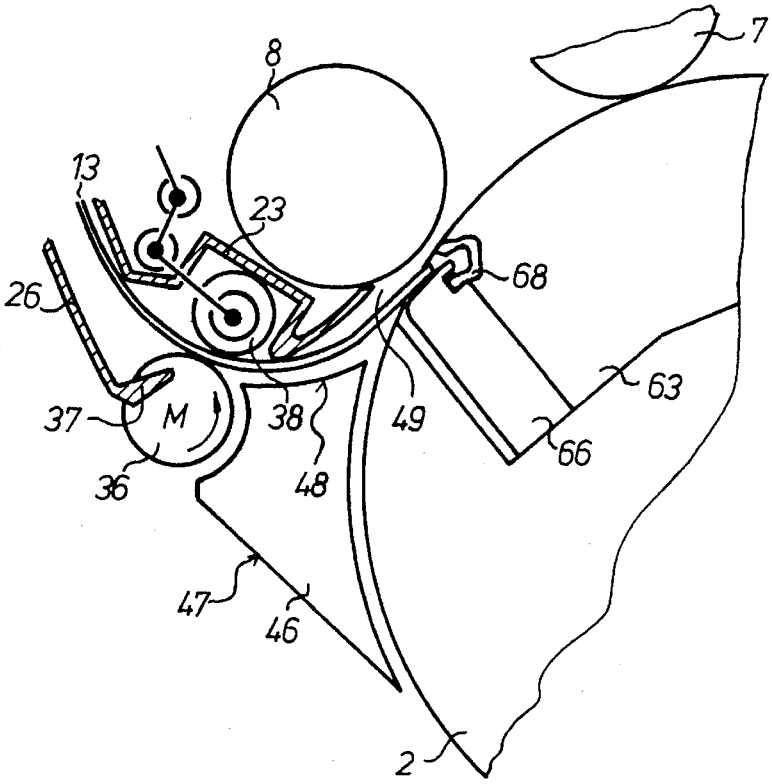
FIG. 5, a partial, enlarged representation of a portion of FIG. 3.

The conveying device 27 consists of a driven conveying roller 36, as shown in FIG. 5, which is fixed on the front side, and which, in the axial direction, has comb-shaped recesses on its periphery. The recesses are engaged by fingers 37 attached at approximately right angles at the lower end of the intermediate wall 26. This conveying roller 36 is driven by a motor, for example a torque-adjustable pneumatic motor. A pressure roller 38, which can be placed against the lower end of the storage compartment 17 for printing plates 13 to be removed, is disposed on one side of this conveying roller 36 and is connected via an angle lever 39, seated fixed in the rear wall, with the piston rod of a work cylinder 41, also seated fixed in the rear wall. A pressure roller 42, which can be placed against the lower end of the storage compartment 16 for printing plates 14 to be fed in, is disposed on the other side of this conveying roller 36 and is connected via an angle lever, seated fixed in the front wall, with the piston rod of a work cylinder 44, also seated fixed in the front wall. The pressure rollers 38, 42 have a soft, resilient surface, for example made of rubber.

A guide bar 46, as may also be seen in FIG. 10, which is embodied trapezoidally in cross section and extending in the axial direction of the plate cylinder 2, is located below the conveying device 27 in the trapezoidally widened part. The underside and the top of the guide bar 46 are each concavely formed and matched to the radius of the plate cylinder 2 or the conveying roller 36. Below the conveying device 27, a first front face 47 of the guide bar 46 constitutes the boundary of the storage compartment 16 for plate feeding in respect to the front wall 18. Below the conveying device 27, a second front face 48 of the guide bar 46 constitutes the boundary of the storage compartment 17 for plate removal in respect to the rear wall 23, or the end of the rear wall 23 pointing in the direction toward the plate cylinder 2 is disposed at such a distance from the contact line 24 of the last ink application roller 8, viewed in the direction of rotation, with the plate cylinder 2, forming an entrance 49, that the printing plate 13 to be removed can be placed into this entrance 49 and can be further conveyed through the storage compartment 17. Viewed from the plate cylinder 2, this entrance 49 tapers in the direction toward the conveying device 27 and thus is wedge-shaped in cross section.

Figure 6:
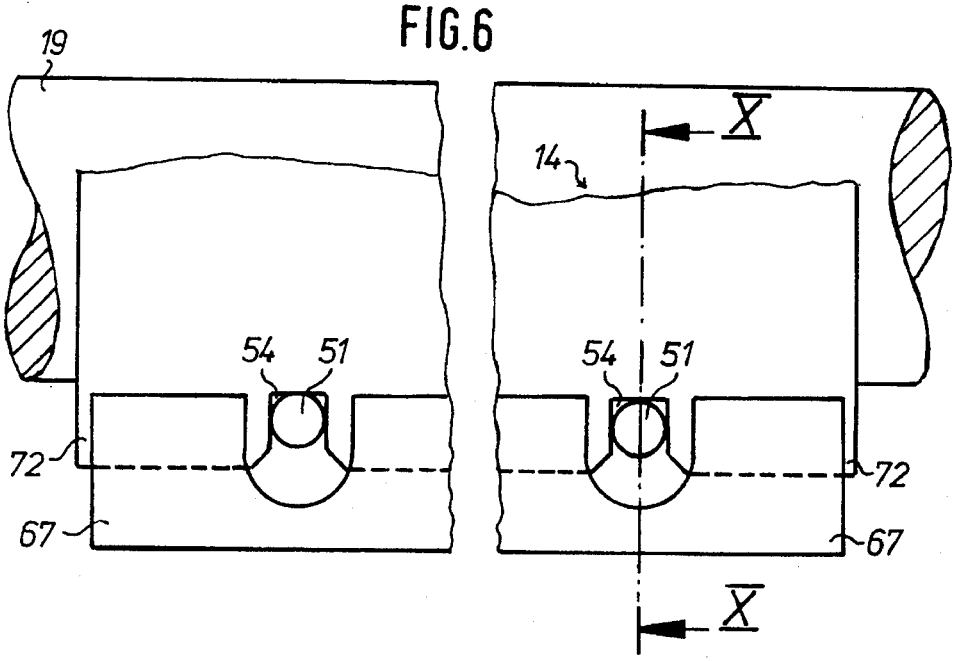
FIG. 6, a representation of the plate front edge of a printing plate in the plate alignment unit.

An alignment unit for the front edge of a plate, identified as a whole by 52, is located between the conveying device 27 and the pressure roller 19. The alignment unit 52 for the front edge of a plate consists of a rotatable shaft 53, seated in the front walls 34 of the removal and feed device 12, with at least two alignment pins or indexing stops 51 extending from the periphery of this shaft 53 in the radial direction and corresponding with alignment devices 54 at the front edges of the printing plates 13, 14 as seen in FIG. 6. The shaft 53 is connected via a rocker 50 through a hinge with the piston rod of a work cylinder 55, fixed on the front wall and hingedly seated.

For repair and maintenance purposes of the printing unit 1, the removal and feed device 12 can be upwardly pivoted around two bearings 56, 57 fixed on the frame by means of a rocker 59 hinged on the front wall 18 and of a two-armed lever 60 hinged on the front wall 18. The two-armed lever 60 is connected with its first lever arm 58 via a bearing fixed on the frame and with its second lever arm 61 via a hinge with the piston rod of a work cylinder 62 fixed on the frame.

In a depression 63, the plate cylinder 2 has a plate clamping device 64 and a plate clamping and gripping device 66. Such a device is known from DE 36 04 071 C2. Open- and closeable clamping flaps or gripper devices 67, 68, which each cooperate with a gripper support surface 70, as seen in FIG. 10 are disposed on the plate clamping devices 64, 66 of the plate cylinder 2 near the periphery of the plate cylinder 2. In this case the gripper device 67 is connected with the front edge, i.e. the start of the print, and the gripper device 68 always with the rear edge, i.e. the end of the print, of the respective printing plate 13, 14. Actuating means provided for actuating the gripper device 67, 68 or the plate clamping device 64, 66 are supplied with work medium via a rotary input (not shown) on a journal of the plate cylinder 2. However, it is also possible to provide devices which supply the plate cylinder with work medium through its front face or jacket surface. The actuating means can be embodied as hydraulic, pneumatic or electrical units. As a rule, the gripper device 67, 68 is designed as a gripper support strip.

In operation, assume that it is intended to change the printing plate at the end of the current print order. For this purpose, as may be seen in FIG. 1, with the application rollers 6 to 9 placed against it, the plate cylinder 2 moves with the front edge 69 of the printing plate 13 past the application rollers 9, 6, 7 to a contact line 24 between the last application roller 8, viewed in the production rotating direction of the plate cylinder 2 (counterclockwise), and the plate cylinder 2, with the printing plate 13 located in between. After the printing plate front edge 69 has passed the contact line 24, the gripper device 67 opens and, because of its inherent tension, the printing plate front edge 69 springs against the lower end 71 of the rear wall 23, so that starting at the contact line 24 the printing plate front edge 69 takes up an at least tangential position in relation to the plate cylinder 2 (FIG. 1). In this way the printing plate front edge 69 moves into the tapering gap 49. As will be described extensively later, a fresh printing plate 14 can already be in the standby position at this time. Because of the continued counterclockwise rotation of the plate cylinder 2 in the production direction, the printing plate front edge 69 passes through the curved lower portion of the storage compartment 17 because of the frictional connection with the application rollers 6 to 9, in the course of which the pressure roller 38 of the conveying device 27 located in the lower part of the removal and feed device 12 is shut off and the air conduits 28, 29 are permanently charged with compressed air, so that the sensitive side of the printing plate 13, 14 is always distanced from the front wall 18 or the rear wall 23 of the removal and feed device 12, as may be seen in FIG. 2.

At this time the fresh printing plate 14 is fed with its printing plate front edge 72 to the plate cylinder 2 and fastened thereon.

Figure 3:
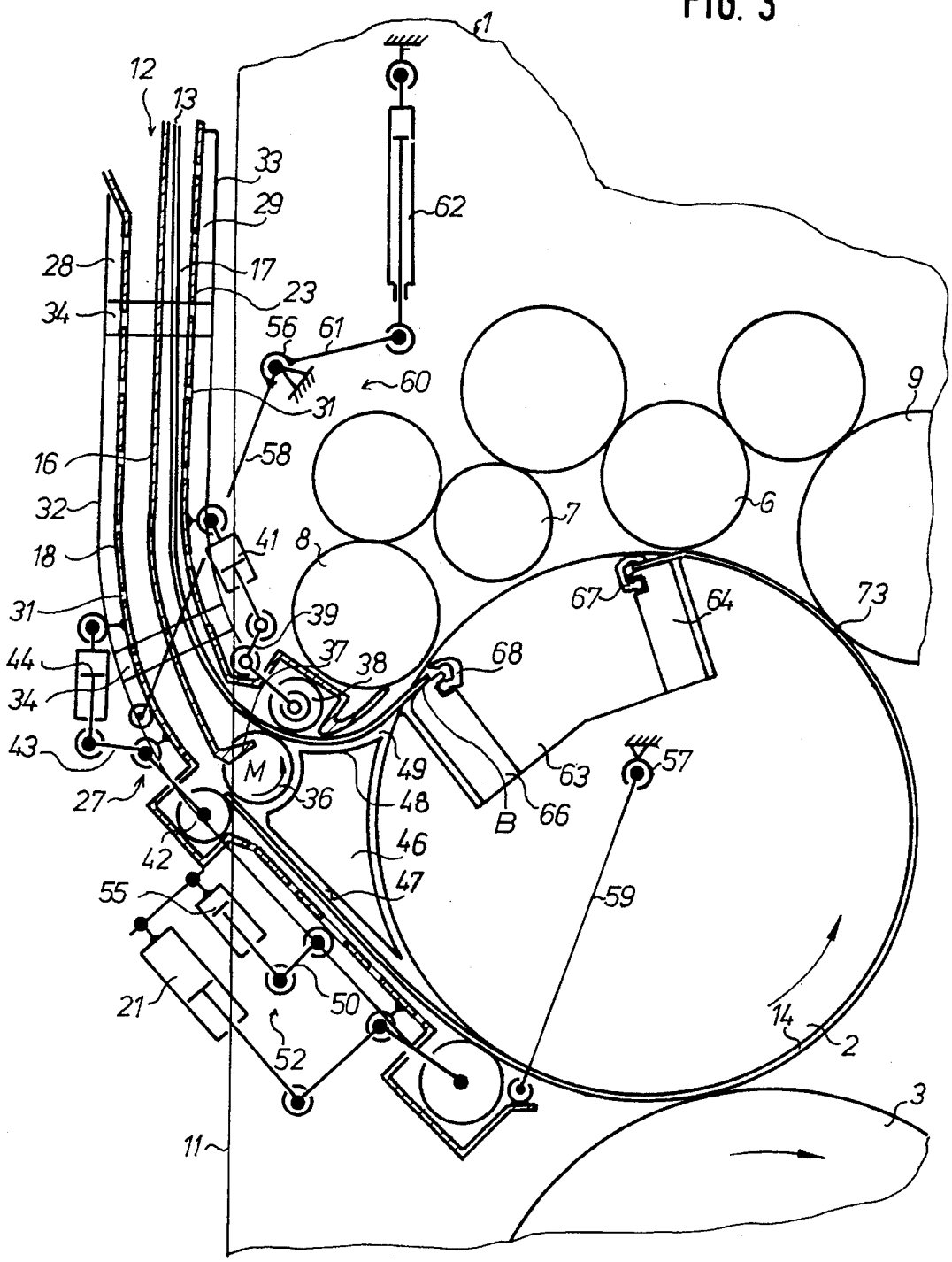

Because of the continuing rotation of the plate cylinder 2 in the production rotation direction, the trailing end of the printing plate 13 reaches the contact line 24 between the last application roller 8 and the plate cylinder 2 with the end of the printing plate 13 disposed between them. The gripper device 68 opens and with its softly resilient cover the pressure roller 38 pushes the printing plate 13 against the driven conveying roller 36, so that the printing plate 13 continues to be conveyed in the vertical direction to the outlet of the removal and feed device 12, as depicted in FIG. 3. The application rollers 6 to 9 can also be shut off (FIG. 3).

At this time the printing plate 14 is further attached by rotating the plate cylinder 2.

Figure 4:
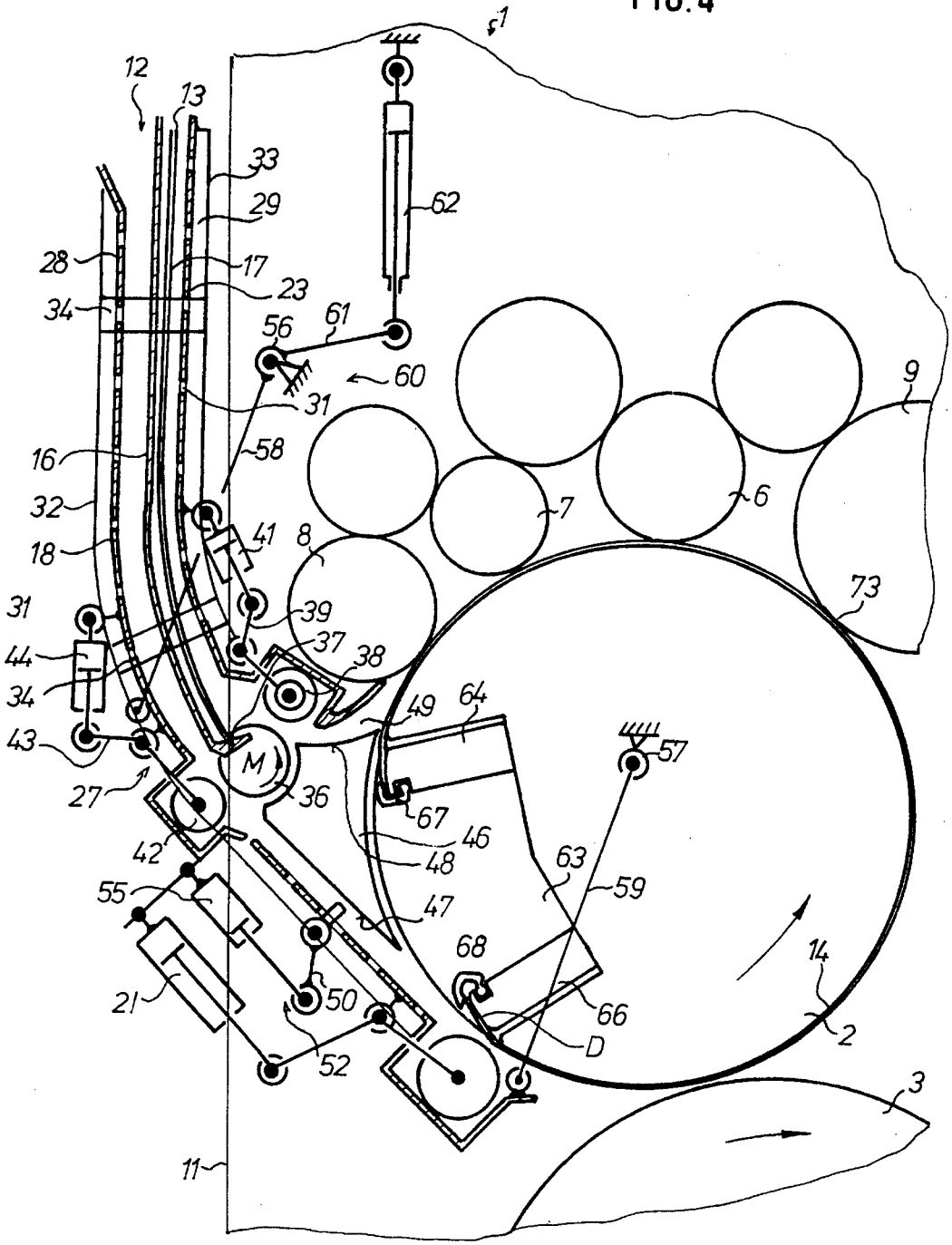

While the plate cylinder 2 continues to turn in the production rotation direction, the printing plate end of the printing plate 13, because of the conveying movement of the conveying device 27, reaches the fingers 37 on which the printing plate 13 is now placed in readiness for removal, as is shown in FIG. 4. The fresh printing plate 14 now simultaneously rests with its plate trailing end on the plate cylinder 2 and is clamped by plate training end gripper 68.

Alternatively to the process step described in connection with FIG. 1, the start of the plate removal from the plate cylinder 2 can also take place in such a way that after reaching a contact line 73 located between the circumference of the moisture application roller 9 and the circumference of the plate cylinder 2, all application rollers 6 to 9 resting against the plate cylinder 2 are turned off by the plate front edge 69, i.e. by known means they are moved back a few millimeters. Simultaneously therewith the gripper bar 67 opens, so that the printing plate 13 relaxes and its front edge 69 rests loosely against the application rollers 6 to 9, so that the conveyance of the printing plate 13 to the storage compartment 17 takes place in an interlocking and frictionally connected manner by means of the gripper bar 68.

Figure 2:
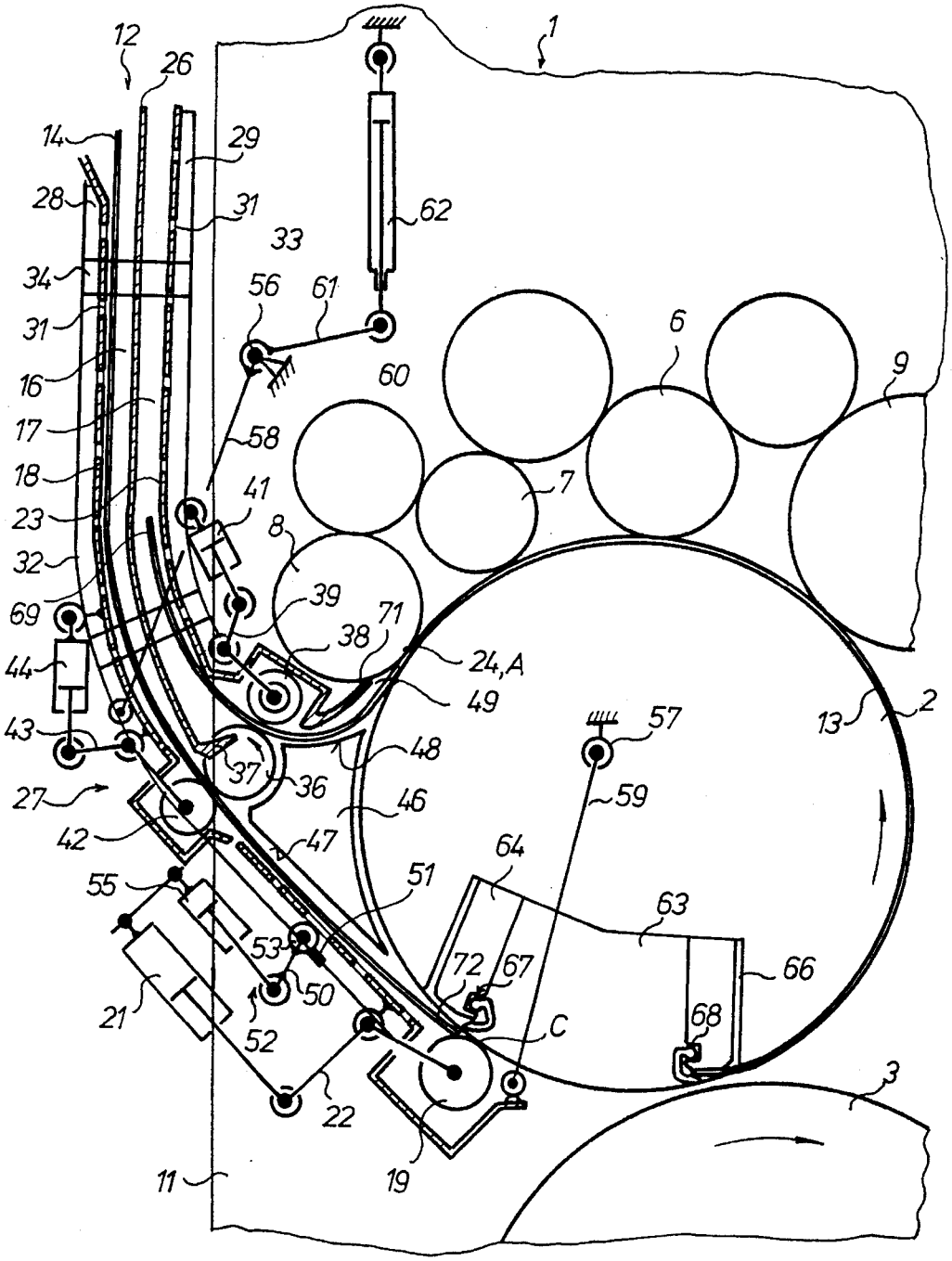

The plate feed of a fresh printing plate 14 to the plate cylinder 2 is described in more detail in what follows. With the pressure roller 42 of the conveying device 27 not in contact, the printing plate front edge 72 of the printing plate 14 to be fed in is inserted into the storage compartment 16 of the removal and feed device 12 and with its alignment slits 54 located at the plate front edge, as seen in FIG. 6, it engages the alignment pins 51 located on the shaft 53 and projecting into the lower portion of the storage compartment 16, by means of which the alignment of the printing plate 14 takes place. Thus, the printing plate 14 is located in the standby position on the plate alignment unit 52 as shown in FIG. 1. While the opened leading edge gripper bar 67 of the plate cylinder 2 approaches the lower end of the storage compartment 16, the shaft 53 is turned by 90° so that the alignment pins come out of engagement with the alignment slits 54 at the plate front edge 72 of the printing plate 14. Simultaneously therewith the pressure roller 42, which is provided with a softly resilient cover, is pushed against the printing plate 14 and thus against the driven, counterclockwise rotating conveying roller 36 of the conveying device 27. The pressure roller 42 and the conveying roller 36 turn with a circumferential speed which is 1.1 to 1.2 times the circumferential speed of the plate cylinder 2, so that the aligned printing plate 14 is fed to the plate cylinder 2 at an accelerated speed and moves with the alignment slits 54 against the stops of alignment pins 51 which are disposed on the plate cylinder 2, but in particular on the plate clamping device 64 located in the cylinder depression 63, as shown in FIG. 10. Subsequently, the plate leading edge gripper device 67 closes and holds the printing plate front edge 72 in an interlocking and frictionally connected manner. The pressure roller 19, provided with a softly resilient cover, is placed against the plate cylinder 2 or against the printing plate 14 located between them (FIG. 2). The plate cylinder 2 now continues to turn in the production rotation direction and the pressure roller 42 pressing against the plate cylinder 2 is pivoted away and thus brought into the rest position (FIG. 3). Because of the continued turning of the plate cylinder 2, the printing plate 13 to be removed leaves the plate cylinder 2 and the plate trailing edge gripper bar 68, which was opened by this, can grip the trailing end of the printing plate 14 in an interlocking and frictionally connected manner. The pressure roller 19 is shut off. Plate transfer is now completed (FIG. 4).

Alternatively with the process step described in connection with FIG. 2, the feeding of the plate to the plate cylinder can also take place in that a printing plate 14 provided with alignment devices 54 on its plate front edge 72 is guided from the storage compartment 16 in the direction of the plate cylinder 2 as far as the alignment unit 52 for the front edge of a plate, is subsequently aligned there and is maintained in the standby position. Subsequently, the plate cylinder 2 interrupts its rotating movement and the conveying device 27, consisting of the pressure roller 42 and the driven conveying roller 36, conveys the printing plate 14 in a tangential direction to a gripper support surface 70 on the plate cylinder 2, as seen in FIG. 10 on which indexing stops 51 are disposed.

Figure 7:
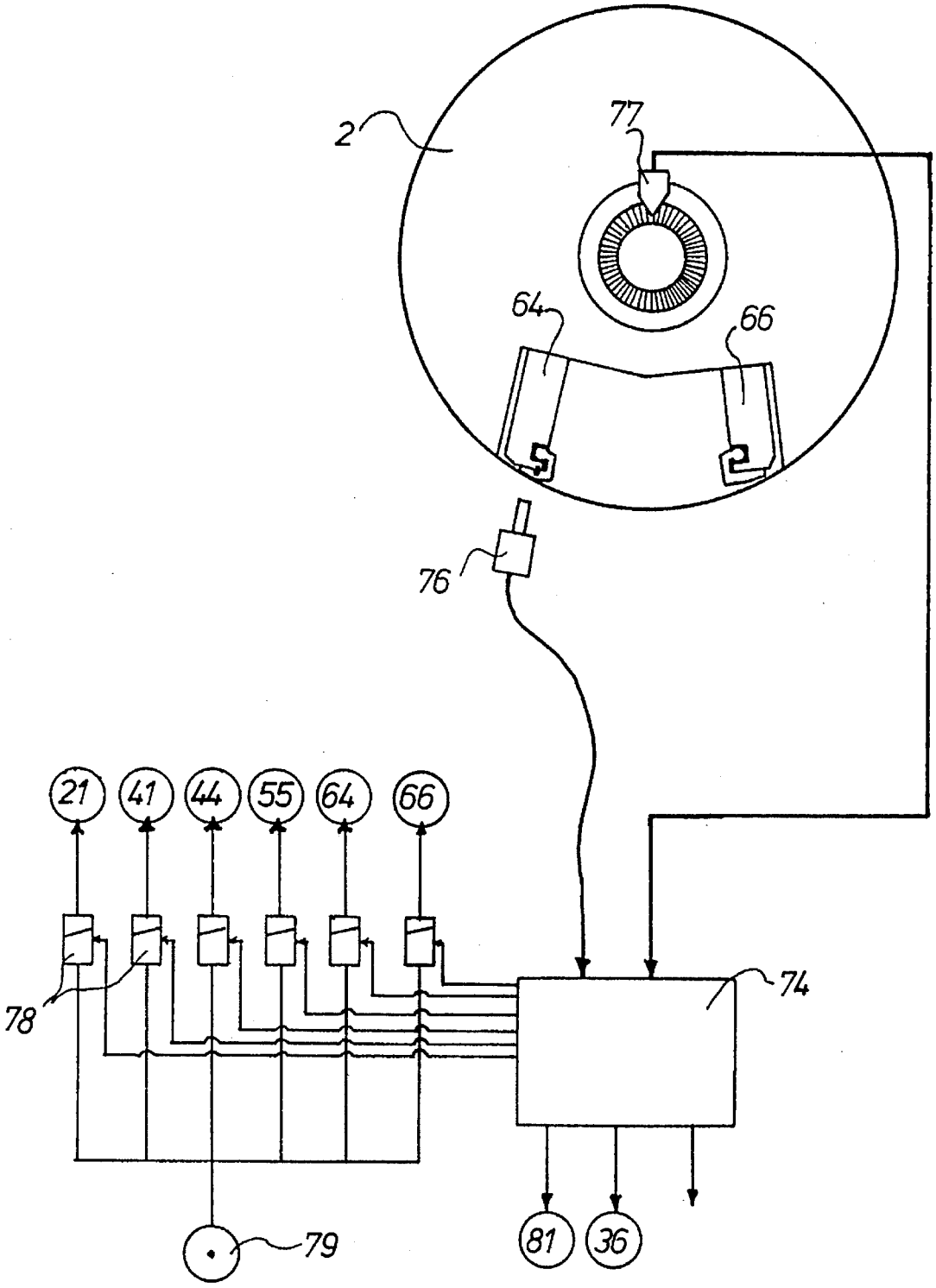
FIG. 7, a control device and a control computer.

FIG. 7 shows the representation of a control device and a control computer 74 for use with the present invention. The control computer 74 receives its information on the one hand from a position transmitter 76 for monitoring the resting of the printing plate 13, 14 with its adjustment devices against the stop 51 on the plate cylinder 2. 0n the other hand, the control computer 74 receives information by means of a position transmitter 77 disposed on the plate cylinder 2. The control computer 74 is furthermore connected with a number of electromagnetic valves 78, which, upon a command to change printing plates, are switched in the correct sequence as a function of the positions of the plate cylinder 2 and in connection with suitable software and supply the work cylinders with a working medium, for example compressed air from a pressure source 79. Also, all electrical drive elements, for example the drive 81 for the printing unit and thus also for the plate cylinder 2, are controlled by the control computer 74. The software of the control computer 74 operates in accordance with a flow chart that is shown in FIGS. 8 and 9, so that the steps 101 to 107 or 201 to 216, as will now be discussed are performed automatically in sequence.

Figure 8:
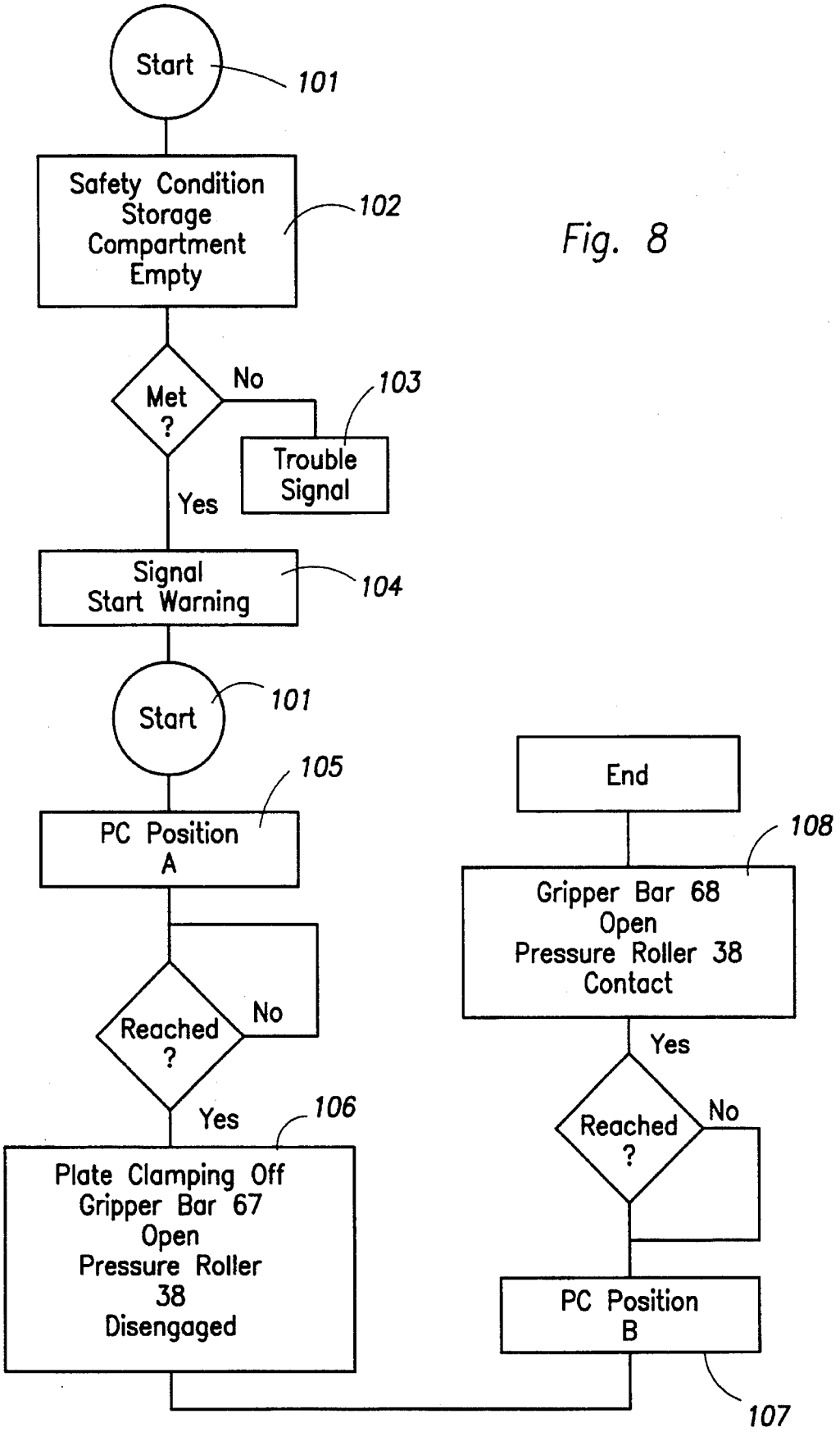
FIG. 8, a flow chart for the removal of a printing plate from the plate cylinder.

FIG. 8 shows the flow chart for unclamping and removing the printing plate 13 from the plate cylinder 2 or placement into the storage compartment 17 of the removal and feed device 12. An interrogation 102 of the safety conditions is performed by actuating a starting trigger 101, to determine, for example, whether the removal and feed device 12 is in the operating position. The device 12 could also be situated in its upwardly pivoted position remote from the cylinder by means of the manually operable work cylinder 62. Appropriate sensors are thereupon activated. Among other things, the interrogation whether the storage compartment 17 is free is performed. If these conditions are not met, a trouble signal 103 is generated. When all safety conditions have been met, a start warning signal 104 is generated. The plate cylinder 2 is turned at creep speed into the plate cylinder position A (PC Position A) 105 in FIG. 1 by means of a renewed actuation of the starting trigger 101. In the plate cylinder position A the front edge 69 of the printing plate 13 at the contact line 24 is just in contact with the application roller 8 and the plate cylinder 2. After the plate front edge 69 has passed the contact line 24, the plate clamping device 64 is released in a step 106, the gripper bar 67 of the plate clamping device 64 is opened and the pressure roller 38 is moved out by the work cylinder 41. Thereafter, following continued turning of the plate cylinder 2, the end of the pressure plate 13 reaches the contact line 24 between the last application roller 8 and the plate cylinder 2 (PC Position 2) in a step 107 (FIG. 3). In a subsequent step 108, the gripper bar 68 of the plate clamping and gripping device 66 opens and the pressure roller 38 in the storage compartment 17 is brought into contact. The printing plate 13 lies ready for removal on the fingers 37.

Figure 9:
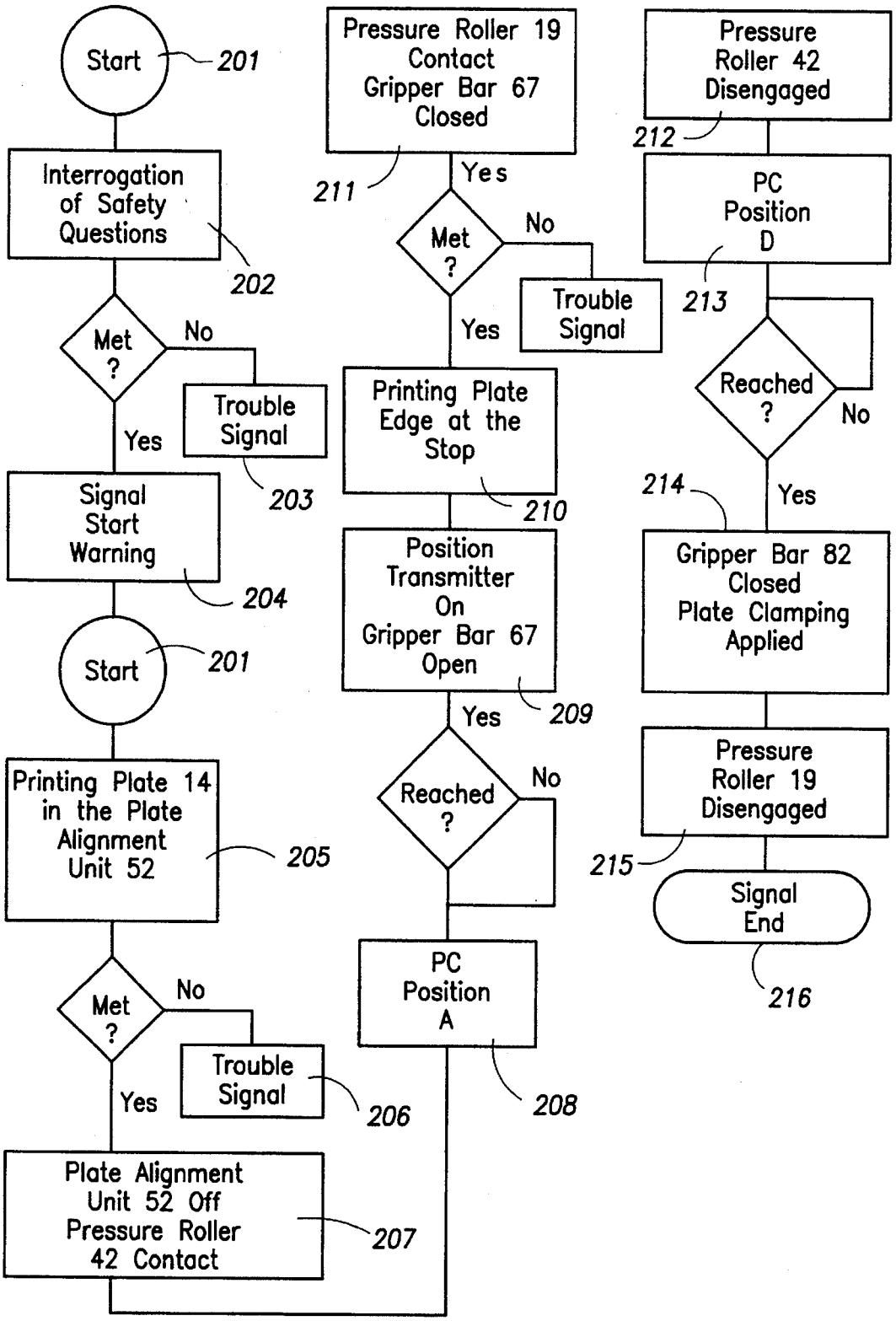
FIG. 9, a flow chart for feeding a printing plate to the plate cylinder; and, FIG. 10, a section taken along the line X—X in accordance with FIG. 6 and with an enlarged representation of a detail in accordance with FIG. 2.

FIG. 9 shows a flow chart in accordance with which the control computer 74 operates in connection with the other position indicators (for example the angle of rotation transmitter 77) so that the printing plate 14 is brought to the plate cylinder 2. An interrogation 202 of the safety conditions is performed by actuating a starting trigger 201 for example to determine whether the removal and feed device 12 is in the operating position. Appropriate sensors are thereupon activated. If all conditions are not met, a trouble signal 203 is generated. When all safety conditions have been met, a start warning signal 204 is generated. Renewed actuation of the starting trigger 201 activates the drive 81 of the plate cylinder. A following interrogation 205 relates to the presence of a fresh printing plate 14 in the storage compartment 16, wherein the alignment devices 54 of the printing plate front edge 72 of the printing plate 14 interlockingly receive the stops or alignment pins 51. A trouble signal 206 is generated if the printing plate 14 is missing. While the plate cylinder 2 approaches, with its opened gripper device 67, a cylinder position C (FIG. 2) at the lower end of the storage compartment 16, the alignment unit 52 is shut off in a step 207 by means of the actuation of the work cylinder 55 and simultaneously the pressure roller 42 is pushed in the direction toward the rotating conveying roller 36 by the actuation of the work cylinder 44. In a subsequent step 208, the plate cylinder 2 is turned into a position C (FIG. 2), so that the printing plate 14 fed to the plate cylinder 2 at an accelerated speed. In a further step 209, another check is made whether the gripper bar 67 is still open, and in a step 210 a check is made whether the printing plate front edge 72 of the aligned printing plate 14 rests against the stops 51 on the plate cylinder 2. The position transmitter 76 and the angle of rotation transmitter 77 are switched on. A trouble signal is generated in case the printing plate front edge 72 is not in contact or not in correct contact. Subsequently, the gripper device 67 is closed in a step 211 and the printing plate front edge 72 of the printing plate 14 is maintained interlockingly and in a frictionally connected manner and the pressure roller 19 is pivoted against the periphery of the plate cylinder 2 by the work cylinder 21. The pressure roller 38 is shut off in a further step 212 by actuating the work cylinder 41. Following a further counterclockwise rotation of the plate cylinder 2 in the production direction, a plate cylinder position D (FIG. 4) is attained in a following step 213, wherein the end of the printing plate 14 rests on the plate cylinder 2 and is subsequently maintained in a frictionally connected manner by the gripper bar 68 in a step 214. The printing plate 14 is clamped. In a step 215 the pressure roller 19 is shut off by actuation of the work cylinder 21. The plate change operation is terminated. Following this a termination signal 216 is generated.

The work cylinders 21, 41, 44, 55, 62 are embodied as double-acting pneumatic work cylinders, whose inlet and outlet connector for compressed air are not shown. The plate clamping device 64, located in the cylinder depression 63, for fastening the printing plate front edge 69, 72 can also be embodied as a combined plate clamping and gripping device. The ink application roller 8 can also be embodied as a separate roller which, for example, can perform the function of a reversing roller and can be separately actuable, i.e. can be placed against the plate cylinder 2 separately from the ink application rollers 6, 7, 9.

Figure 10:
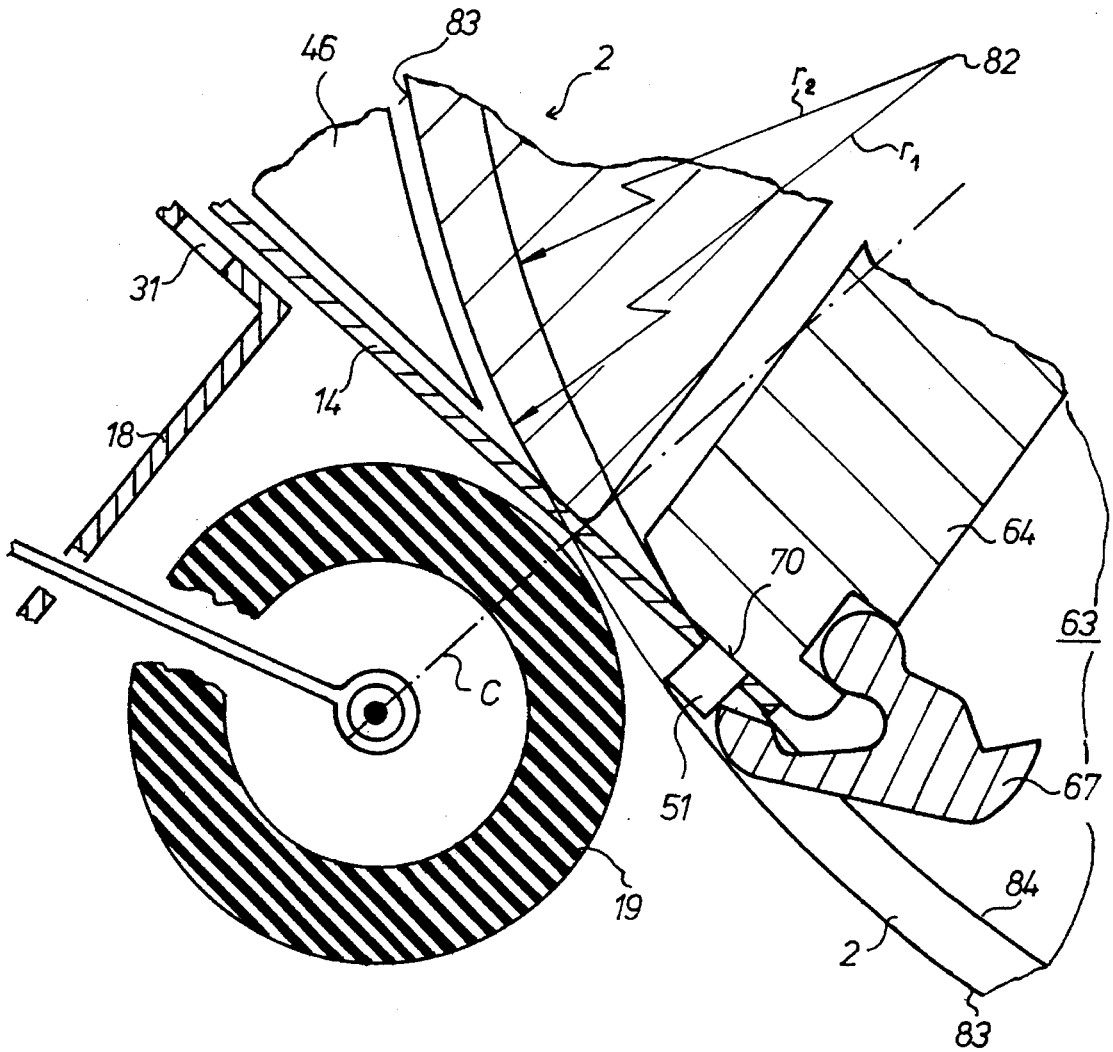

FIG. 10 shows a cross section taken along line X—X of FIG. 6 with an enlarged detail representation in connection with FIG. 2. Starting from an axis of rotation 82 of the plate cylinder 2, with this axis of rotation constituting the center of the circle, an outer circle 83 with the radius $r_1$ defines the circumference of the plate cylinder 2 with its generated area. A further, inner circle 84 has a radius $r_2$ which extends from the axis of rotation 82 of the plate cylinder 2 and almost reaches the gripper support surface 70. The radius $r_2$ is less than the radius $r_1$.

On its end close to the plate cylinder 2 the storage compartment 16 has a compartment end 86, which extends tangentially to a circle concentric to circle 83 or 84, and whose radius lies between the radii $r_1$ and $r_2$. The compartment end 86 extends tangentially to the plate cylinder 2 in the III. quadrant of a right-angled coordinate system relative to the plate cylinder cross section. On its end close to the plate cylinder, the storage compartment 17 has a compartment end 87 which extends tangentially to a circle concentric to circle 83 or 84 and, whose radius lies between the radii $r_1$ and $r_2$. The compartment end 87 extends tangentially to the plate cylinder 2 in the II. quadrant of a right-angled coordinate system (FIG. 1). The compartment ends 86, 87 are respectively placed opposite each other in the area of two adjoining quadrants II and III. However, they can also be placed opposite each other in adjoining quadrants I or IV or I and II.

We claim:

1. A printing plate supply and removal device for use in supplying and removing printing plates to a plate cylinder of a rotary printing press comprising:

plate cylinder having a peripheral jacket surface;

controlled grippers which cooperate with gripper support surfaces, said controlled grippers and said gripper support surfaces being fixed on said peripheral surface of said plate cylinder;

a printing plate storage container having a first compartment for the removal of printing plates from said plate cylinder and a second compartment for the supply of printing plates to said plate cylinder, said first compartment having a first compartment end and said second compartment having a second compartment end;

an arbitrary circle whose radius maximally coincides with a radius of said jacket of said plate cylinder and minimally coincides with a radius of a circle which extends below said gripper support surfaces, said first compartment end and said second compartment end being tangentially aligned with said arbitrary circle; and a guide bar disposed between said first and second ends of said printing plate supply compartment and said printing removal compartment, said first and second ends being spaced from each other by said guide bar and being located apart from each other in the area of two directly adjoining quadrants of said plate cylinder.

2. A printing plate supply and removal device in accordance with claim 1 wherein said guide bar is disposed between said compartment ends extending in a first direction toward said plate cylinder and in a second direction parallel with an axis of rotation of said plate cylinder, said guide bar being generally trapezoidal in cross section and widening in cross section in a direction toward said plate cylinder and having an underside adapted in shape to that of said peripheral surface of said plate cylinder, said guide bar having a first front face which constitutes a boundary of said second compartment end of said second compartment for the supply of printing plates, and having a second front face which constitutes a boundary of said first compartment end of said first compartment for the removal of printing plates.

3. A printing plate supply and removal device in accordance with claim 2 further including a conveying roller which extends parallel with an axis of rotation of said plate cylinder and a torque-adjustable pneumatic motor, said pneumatic motor being usable to drive said conveying roller, said conveying roller being positioned in said storage container adjacent a top of said guide bar.

4. A printing plate supply and removal device in accordance with claim 1 wherein said first and second compartment ends of said storage container cooperate to form a funnel-shaped entrance into said storage container from adjacent said peripheral surface of said plate cylinder.

5. A printing plate supply and removal device in accordance with claim 1 further including a rotatable roller which is supported adjacent said plate cylinder and in the immediate vicinity of an upper wall of said first compartment end.

* * * * *